US008403691B1

(12) United States Patent
Liang

(10) Patent No.: US 8,403,691 B1
(45) Date of Patent: Mar. 26, 2013

(54) FAN CONNECTOR

(75) Inventor: An-Gang Liang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/287,134

(22) Filed: Nov. 2, 2011

(30) Foreign Application Priority Data

Oct. 12, 2011 (CN) ..... 201110308116

(51) Int. Cl.
*H01R 27/00* (2006.01)

(52) U.S. Cl. ..... 439/222; 439/682

(58) Field of Classification Search ..... 439/222, 439/682, 218, 680
See application file for complete search history.

(56) References Cited

U.S. PATENT DOCUMENTS

| | | | | |
|---|---|---|---|---|
| 4,606,599 | A * | 8/1986 | Grant et al. | 439/857 |
| 5,588,878 | A * | 12/1996 | Flinchbaugh et al. | 439/682 |
| 6,030,241 | A * | 2/2000 | Chiba | 439/222 |
| 7,794,289 | B1 * | 9/2010 | Chen et al. | 439/682 |

* cited by examiner

*Primary Examiner* — Gary F. Paumen
(74) *Attorney, Agent, or Firm* — Altis Law Group, Inc.

(57) ABSTRACT

A fan connector for being connected to either a first fan header having a number of first pins or a second fan header having a number of second pins includes a main body, a number of first holes defined in the main body for electrically receiving the first pins, and a number second holes defined in the main body for electrically receiving the second pins.

2 Claims, 4 Drawing Sheets

FAN CONNECTOR

BACKGROUND

1. Technical Field

The present disclosure relates connectors and, particularly, to a fan connector.

2. Description of Related Art

Different fan headers are generally mounted to a motherboard, to be electrically connected to different fan connectors. Thus, in assembly, a fan having a fan connector must be connected to the corresponding fan header, which is troublesome.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
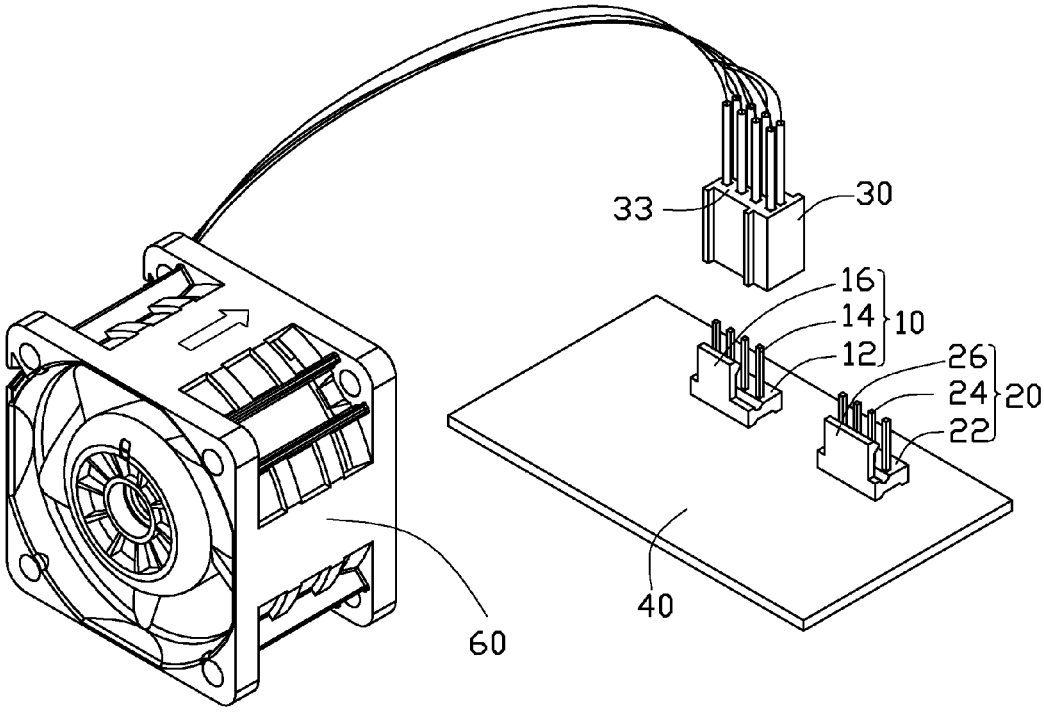
FIG. 1 is an exploded, isometric view of an exemplary embodiment of a fan connector together with a fan and a motherboard.
Figure 2:
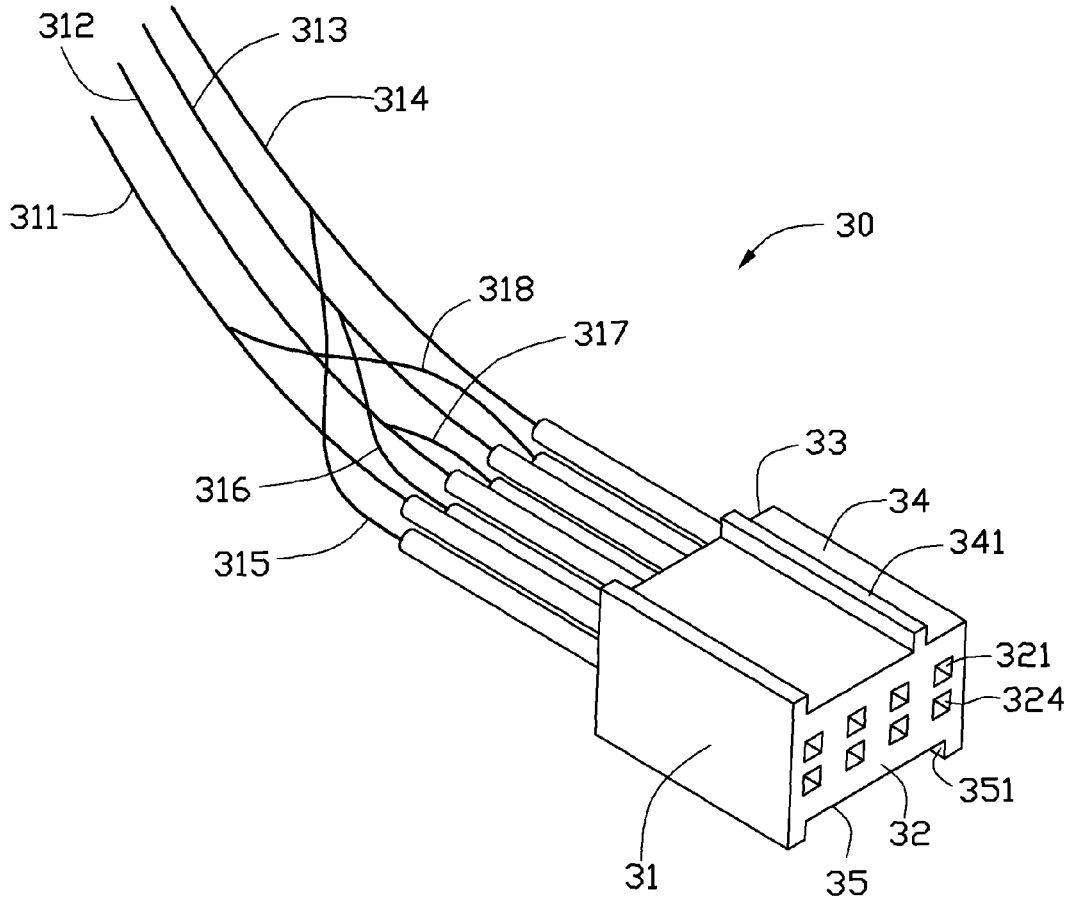
FIG. 2 is an enlarged view of the fan connector of FIG. 1, but viewed from another perspective.

Referring to FIGS. 1 and 2, an exemplary embodiment of a fan connector 30 is provided to be connected to either a first fan header 10 or a second fan header 20 on a motherboard 40.

The first fan header 10 is a common mistake-proof 4-pin fan header which is compatible with a 3-pin fan header. The first fan header 10 includes a first base 12, four spaced first pins 14 perpendicularly extending up from the first base 12, and a mistake-proof first hook 16 perpendicularly extending up from a side of the first base 12 and aligning with three of the first pins 14. The top of the first hook 16 is bent towards the three first pins 14.

The second fan header 20 is a common mistake-proof 4-pin fan header which is incompatible with a 3-pin fan header. The second fan header 20 includes a second base 22, four spaced second pins 24 perpendicularly extending up from the second base 22, and a mistake-proof second hook 26 perpendicularly extending up from a side of the second base 22 and aligning with the four second pins 24. The top of the second hook 26 is bent towards the four second pins 24.

The fan connector 30 includes a substantially rectangular main body 31. The main body 31 includes a bottom wall 32, a top wall 33, a first sidewall 34, and a second sidewall 35 opposite to the first sidewall 34. Four spaced first holes 321 are defined in the bottom wall 32 adjacent to the first sidewall 34, and four spaced second holes 324 are defined in the bottom wall 32 adjacent to the second sidewall 35. Two first flanges 341 are respectively formed on an end of the first sidewall 34 and a portion of the first sidewall 34 adjacent to an opposite end. Two second flanges 351 are respectively formed on opposite ends of the second sidewall 35. A distance between the second flanges 351 is larger than a distance between the first flanges 341.

A first cable 311, a second cable 312, a third cable 313, and a fourth cable 314 extend through the top wall 33 and are electrically connected to pins (not shown) in the four first holes 321 from left to right of the bottom wall 32, respectively. A fifth cable 315, a sixth cable 316, a seventh cable 317, and an eighth cable 318 extend through the top wall 33 and are electrically connected to pins (not shown) in the four second holes 324 from left to right of the bottom wall 32, respectively. Distal ends of the first, second, third, and fourth cables 311, 312, 313, and 314, away from the main body 31 are electrically connected to a fan 60. Distal ends of the fifth, sixth, seventh, and eighth cables 315, 316, 317, and 318, away from the main body 31 are electrically connected to the fourth, third, second, and first cables 314, 313, 312, and 311, respectively.

Figure 3:
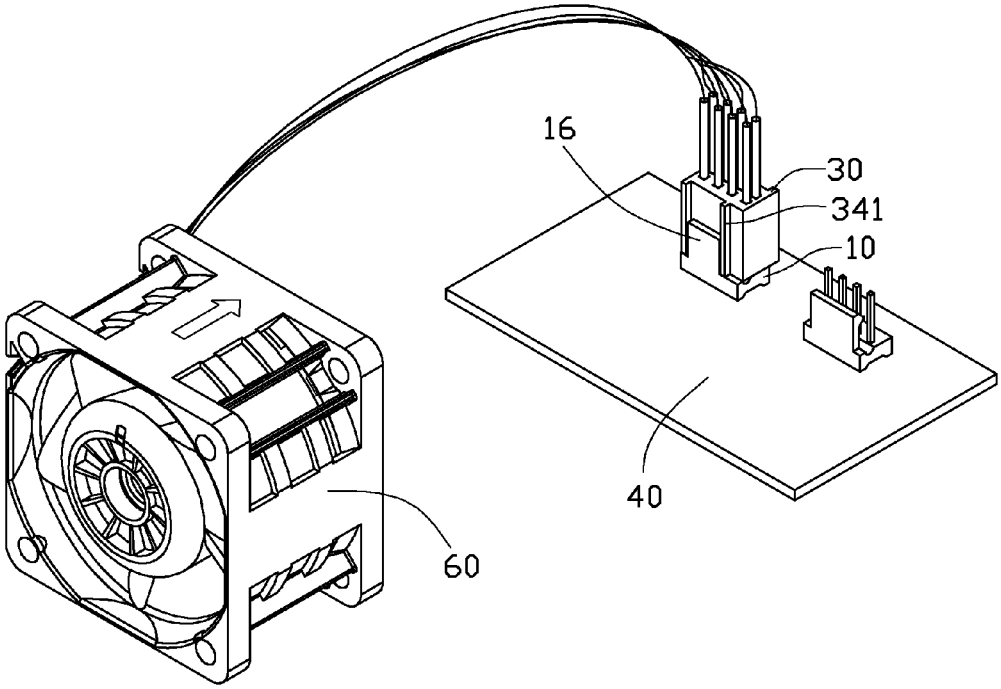
FIG. 3 is an assembled, isometric view of FIG. 1, wherein the fan connector is connected to a first fan header of the motherboard.

Referring to FIG. 3, to connect the fan 60 to the first fan header 10, the fan connector 30 is placed above the first fan header 10, with the first sidewall 34 facing the first hook 16. The fan connector 30 is moved down, to allow the first pins 14 to be inserted into the first holes 321. Therefore, the fan 60 is electrically connected to the first fan header 10, with the first hook 16 engaging in a space between the first flanges 341.

Figure 4:
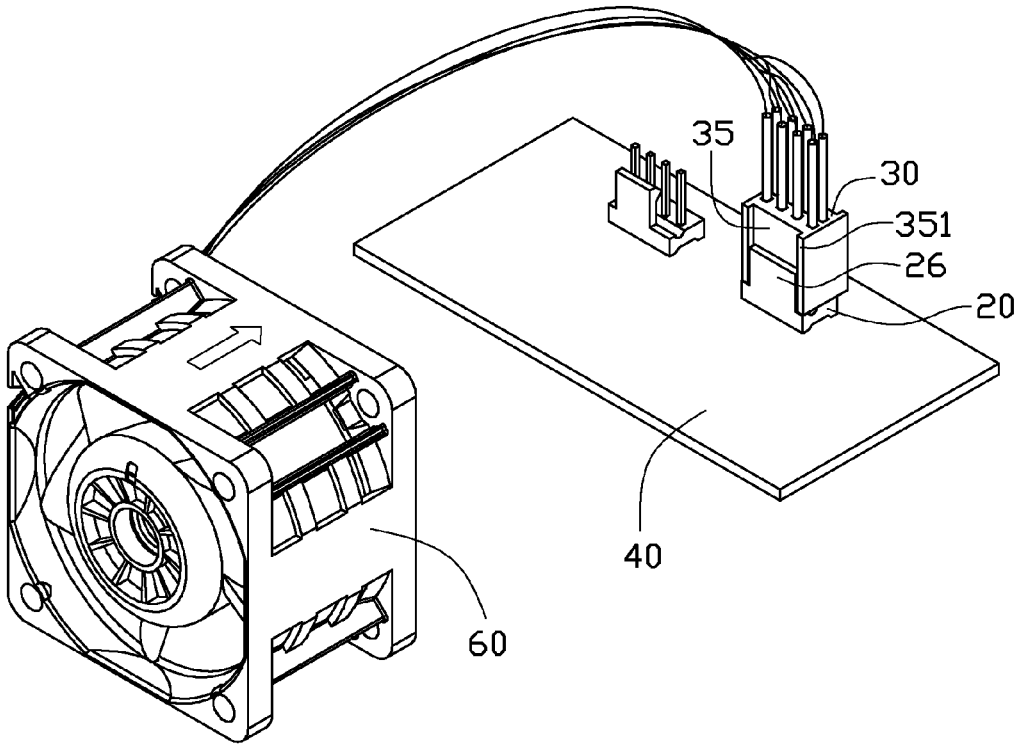
FIG. 4 is an assembled, isometric view of FIG. 1, wherein the fan connector is connected to a second fan header of the motherboard.

Referring to FIG. 4, to connect the fan 60 to the second fan header 20, the fan connector 30 is reversed and placed above the second fan header 20, with the second sidewall 35 facing the second hook 26. The fan connector 30 is moved down, to allow the second pins 24 to be inserted into the second holes 324. Therefore, the fan 60 is electrically connected to the second fan header 20, with the second hook 26 engaging in a space between the second flanges 351.

In the embodiment, the distal ends of the fifth, sixth, seventh, and eighth cables 315, 316, 317, and 318 away from the main body 31 are electrically connected to the fourth, third, second, and first cables 314, 313, 312, and 311, respectively, which will ensure that the fan 60 receives same signals from the motherboard 60 when the fan connector 30 is connected to either the first fan header 10 or the second fan header 20.

Even though numerous characteristics and advantages of the embodiments have been set forth in the foregoing description, together with details of the structure and the functions of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A fan connector for being connected to either a first mistake-proof 4-pin fan header which is compatible with a 3-pin fan header or a second mistake-proof 4-pin fan header which is incompatible with a 3-pin fan header, the first mistake-proof 4-pin fan header comprising a first base, four spaced first pins extending up from the first base, and a mistake-proof first hook perpendicularly extending up from a side of the first base aligning with and bent towards three of the first pins, the second mistake-proof 4-pin fan header comprising a second base, four spaced second pins extending up from the second base, and a mistake-proof second hook perpendicularly extending up from a side of the second base aligning with and bent towards the four second pins, the fan connector comprising:

a main body;

four first holes defined in the main body for electrically receiving the first pins; and four second holes defined in the main body for electrically receiving the second pins; wherein the main body comprises a first sidewall, a second sidewall opposite to the first sidewall, and a bottom wall connected between bottoms of the first and second sidewalls; said four first holes are defined in the bottom wall adjacent to the first sidewall, and said four second holes are defined in the bottom wall adjacent to the second sidewall; two first flanges are respectively formed on an end of the first sidewall and a portion of the first sidewall adjacent to an opposite end for sandwiching the first hook, and two second flanges are respectively formed on opposite ends of the second sidewall for sandwiching the second hook.

2. The fan connector of claim 1, wherein the main body further comprises a top wall opposite to the bottom wall, a first cable, a second cable, a third cable, and a fourth cable extend through the top wall and are respectively electrically connected to said four first holes from left to right of the bottom wall, a fifth cable, a sixth cable, a seventh cable, and an eighth cable extend through the top wall and are respectively electrically connected to the four second holes from left to right of the bottom wall, distal ends of the fifth, sixth, seventh, and eighth cables away from the main body are electrically connected to the fourth, third, second, and first cables respectively, and distal ends of the first, second, third, and fourth cables away from the main body are electrically connected to a fan.

* * * * *